US005088132A

United States Patent [19]

Walka

[11] Patent Number: 5,088,132

[45] Date of Patent: Feb. 18, 1992

[54] HYGIENIC PROTECTIVE SHIELD FOR FLUSH TOILETS

[76] Inventor: Hermann Walka, 701 Kingswood Dr., Tyler, Tex. 75703

[21] Appl. No.: 572,219

[22] Filed: Aug. 24, 1990

[51] Int. Cl.[5] ..... E03D 9/00

[52] U.S. Cl. ..... 4/300.3; 4/661; 428/80; 428/703

[58] Field of Search ..... 4/300.3, DIG. 5, DIG. 18, 4/661; 428/80, 919, 12, 703; 296/97.7, 97.9; D23/307, 309, 310

[56] References Cited

U.S. PATENT DOCUMENTS

| | | | |
|---|---|---|---|
| 538,168 | 4/1895 | Keeler | 4/DIG. 5 |
| 2,980,919 | 4/1961 | Otto et al. | 4/300.3 |
| 3,914,803 | 10/1975 | Gregovski | 4/300.3 |
| 4,125,656 | 11/1978 | Creamer | 428/80 |
| 4,652,039 | 3/1987 | Richards | 296/97.7 |
| 4,716,602 | 1/1988 | Brickhouse | 4/300.3 X |
| 4,873,132 | 10/1989 | Jones et al. | 428/80 |
| 4,944,058 | 7/1990 | Carnahan et al. | 4/DIG. 18 |
| 4,957,803 | 9/1990 | Foley | 428/80 X |

*Primary Examiner*—Henry F. Epstein
*Attorney, Agent, or Firm*—Ronald B. Sefrna

[57] ABSTRACT

An absorbent protective shield to be placed at the rear of the bowl of a toilet and extend outwardly to either side of the toilet to shield adjacent wall surface from liquid splashes. The shield is free standing, with a central cut-out to allow the shield to be placed over a toilet at the rear of the bowl, and is adjustable so that it may be configured around the toilet as desired.

11 Claims, 2 Drawing Sheets

HYGIENIC PROTECTIVE SHIELD FOR FLUSH TOILETS

FIELD OF THE INVENTION

The present invention generally relates to splash shield devices, and, in its preferred embodiments, more particularly relates to a shield device for protecting surfaces adjacent to a toilet from splashes of urine and other liquids.

BACKGROUND OF THE INVENTION

It is typical for toilets to be installed without any provision for containing splashes of urine or other liquids and preventing such liquids from contact wall surfaces adjacent to the toilet. Gypsum board is usually used as the wall cover and gypsum board is sufficiently absorbent that substantially all the moisture coming into contact with such board as a result of splashes of urine, with its concomitant odorous constituents, is absorbed into the wall covering. As a result, the walls adjacent to the toilet, and in may cases the room around the toilet become malodorous. Cleaning or even application of new paint may relieve the odor problem for a short time before the unpleasant smell comes back again.

SUMMARY OF THE INVENTION

The present invention provides a hygienic protective shield, to be disposed between the walls and the bowl of a toilet adjacent to such walls. The shield of the invention is adapted to be placed over a toilet at the rear of the toilet bowl, and may be formed into a suitable configuration to surround the rear and sides of the toilet bowl to intercept splashes and prevent liquid from reaching, and being absorbed by, adjacent walls. The shield of the invention may be made from a low priced absorbent material, like corrugated board or gypsum board, and can be provided with a wide range in design and color and with or without deodorant and/or fragrance. After a period of time, the shield device may be readily removed and exchanged for a new one. The shield device of the invention is used by placing it over the rear side of the toilet bowl and stays in place, supported by the floor around the toilet. The shield of the invention is an easy and cheap way to control odors in the toilet area, and to prevent damage on and in walls around a toilet.

DETAILED DESCRIPTION OF THE INVENTION

Figure 1:
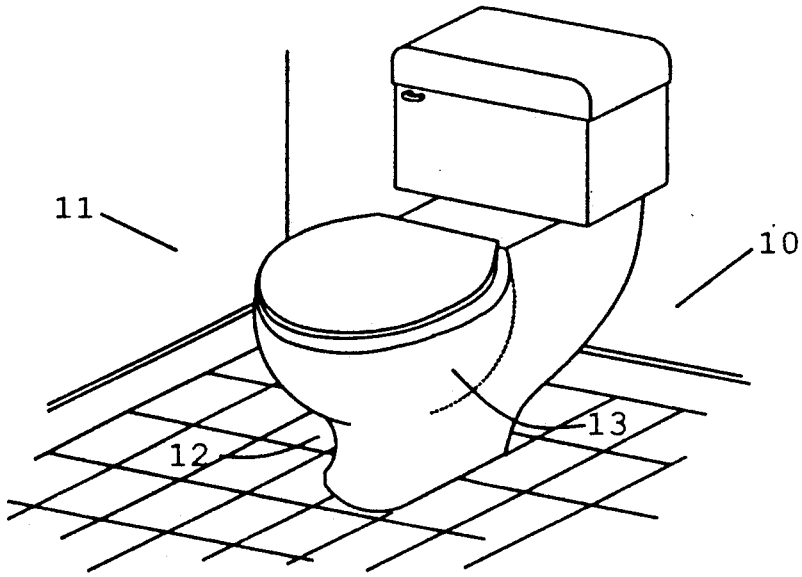
FIG. 1 is a perspective view of a typical flush toilet without any wall protection.

FIG. 1 illustrates a typical flush toilet, which is set in front of a wall 10, and adjacent to a wall 11 as a typical installation. It will be understood that wall 11 may be on the opposite side of the toilet, which is designated by numeral 12, walls may extend along both sides of toilet 12, or wall 10 may be the only wall in proximity to the toilet. However, in almost every installation walls normally are closed to the toilet bowl and are always in danger of being splashed, and thus of being damaged by moisture and retaining odors.

Figure 2:
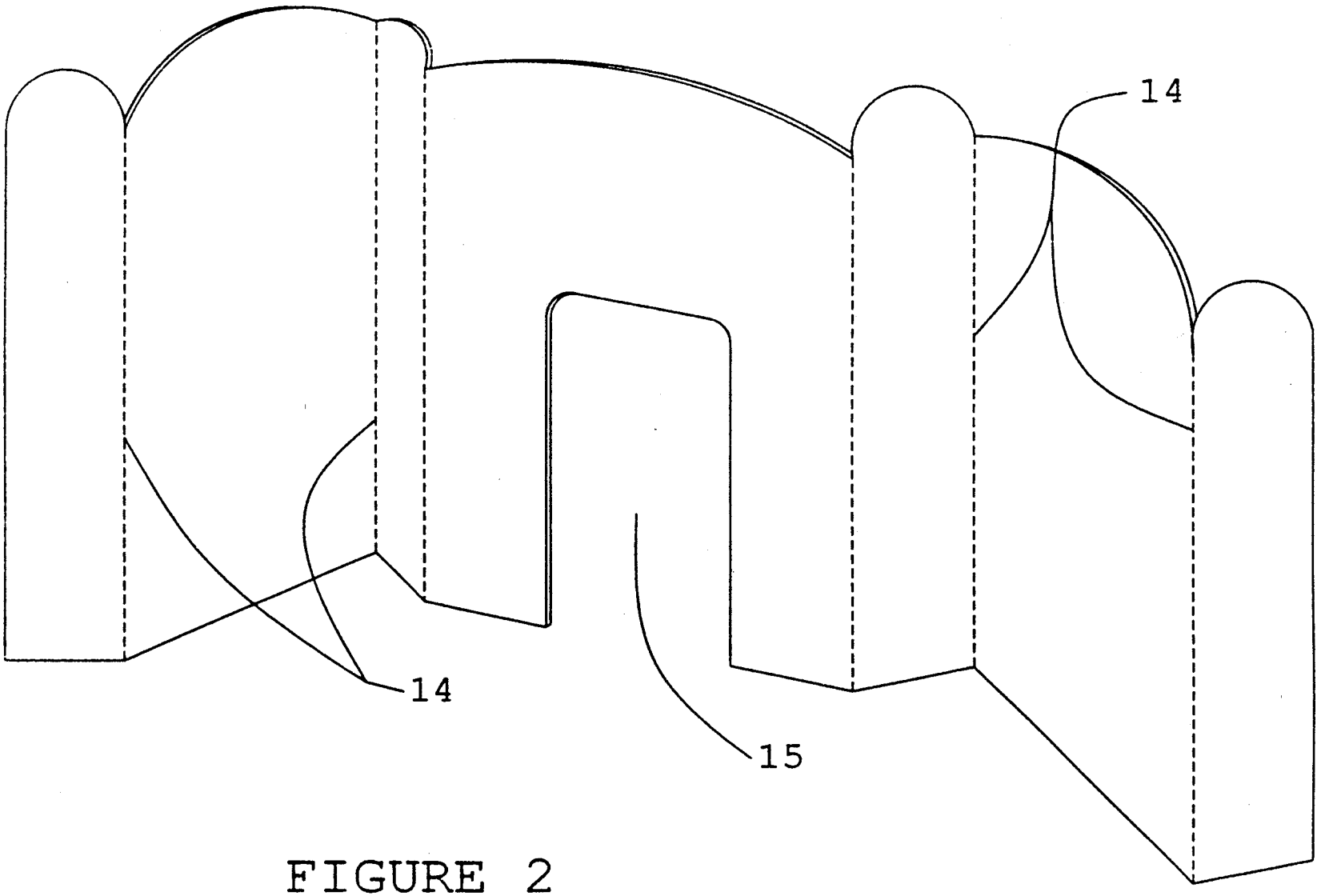
FIG. 2 is a perspective view of the hygienic protective shield of the invention.

The shield device of the invention, illustrated in FIG. 2, is provided with several bend lines 14, so as to allow the shield device to support itself upon the floor, and allow the formation of an appropriate enclosure configuration behind and to the sides of the toilet 12 as a shield between the toilet and walls 10 and/or 11. A centralized cutout notch 15 extending from the bottom edge of the shield device is provided to allow the shield to be placed over the toilet 12 at the rear of bowl 13. The shield device is preferably constructed of an absorbent material, such as gypsum board, corrugated board, or a special low priced paper-plywood-particle board combination. The size, design, and decor of the shield are subject to wide variation within the scope of the invention. The shield devcie of the invention may also be treated with deodorant and/or fragance substances.

Figure 3:
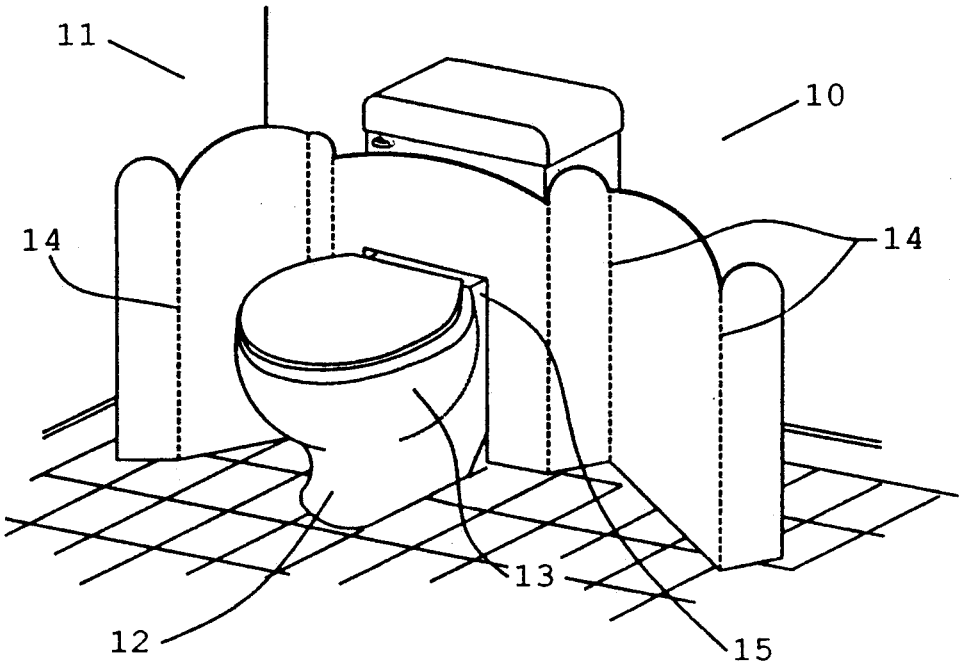
FIG. 3 is a perspective view of the hygienic protective shield of the invention in place in conjunction with a typical flush toilet, illustrating the use of the shield of the invention.

FIG. 3 is an illustration of the shield device of the invention in place in conjuction with a toilet in the corner of a room, with adjacent walls 10 and 11. In the illustrated installation the shield device is bent along the walls behind and to the left of the toilet.

The foregoing description of the invention is illustrative and not for purposes of limitation, and it will be understood that the invention is susceptible to alternative embodiments and variations without departing from the scope and spirit of the invention as claimed.

I claim:

1. A protective shield device for use in conjunction with a toilet disposed over a floor surface and having a toilet bowl, for protecting wall surfaces adjacent to the toilet from splashes of urine and other liquids, comprising:

a planar body of generally rectangular configuration, having an upper edge and a lower edge and first and second ends, said body being of substantially greater width along its upper and lower edges than the width of the toilet, said body including a cutout portion in the form of a notch extending into said body from said lower edge thereof intermediate said first and second ends, said notch being of sufficient width and extension into said body from said lower edge to be received over the portion of a toilet at the rear of the toilet bowl with said lower edge of said body resting upon the floor and with said first and second ends of said body extending upwardly from the floor, and said body further including a plurality of bend lines extending between said lower edge and said upper edge of said body perpendicular to said lower edge, to facilitate bending of said body into a selected configuration around the sides of the toilet bowl.

2. The protective shield device of claim 1, wherein said body is formed of a liquid absorbing material.

3. The protective shield device of claim 1, wherein said body is treated with a deodorant material.

4. The protective shield device of claim 1, wherein said body is treated with a fragrance emitting material.

5. The protective shield device of claim 1, wherein the number of said bend lines is six, and wherein said bend lines are symmetrically disposed on either side of the mid-point of said boby with three of said bend lines between said mid-point and said first end of said body and with three of said bend lines between said mid-point and said second end of said body.

6. The protective shield device of claim 1, wherein said body has a front face and a rear face, and wherein the protective shield device further includes surface ornametation applied to one or both of said faces.

7. The protective shield device of claim 1, wherein the toilet has a flush valve handle, and wherein the height of said body, measured between said lower edge and said upper edge, is less than the height of the flush valve handle of the toilet above the floor.

8. The protective shield device of claim 1, wherein said body is rigid and resistant to bending except along said bend lines.

9. The protective shield device of claim 1, wherein said body is constructed of a gypsum material.

10. The protective shield device of claim 1, wherein said body is constructed of a paper-based material.

11. The protective shield device of claim 1, wherein the material of construction of said body comprises a composite of wood and paper-based material.

* * * * *